US006190005B1

(12) United States Patent
Murakami

(10) Patent No.: US 6,190,005 B1
(45) Date of Patent: Feb. 20, 2001

(54) METHOD FOR MANUFACTURING AN INK JET HEAD

(75) Inventor: Shuichi Murakami, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/341,104

(22) Filed: Nov. 18, 1994

(30) Foreign Application Priority Data

Nov. 19, 1993 (JP) ..... 5-290564

(51) Int. Cl.[7] ..... B41J 2/05; B41J 2/175
(52) U.S. Cl. ..... 347/65; 347/85
(58) Field of Search ..... 347/65, 63, 85, 347/20

(56) References Cited

U.S. PATENT DOCUMENTS 4,334,234 * 6/1982 Shirato ..... 347/65
4,392,907 * 7/1983 Shirato ..... 347/63 X
4,568,953 * 2/1986 Aoki ..... 347/65
4,587,534 * 5/1986 Saito ..... 347/56
4,611,219 * 9/1986 Sugitani ..... 347/65
4,683,481 * 7/1987 Johnson ..... 347/65
4,789,425 * 12/1988 Drake ..... 347/63 X
4,829,324 * 5/1989 Drake ..... 347/63
4,922,269 * 5/1990 Ikeda ..... 347/58 X
5,189,443 * 2/1993 Arashima ..... 347/63
5,387,314 * 2/1995 Baughman ..... 347/65 X
5,389,962 * 2/1995 Sekiya ..... 347/65

* cited by examiner

*Primary Examiner*—John Barlow
*Assistant Examiner*—M. Brooke
(74) *Attorney, Agent, or Firm*—Fitzpatrick, Cella, Harper & Scinto

(57) ABSTRACT

A method for manufacturing plural liquid jet recording heads, each head having a substrate with ejection energy generating elements corresponding to liquid passages and a liquid supply groove for supplying liquid to the liquid passages, by preparing a base member on which the ejection energy generating elements are disposed corresponding to the substrates, forming in the base member by dicing a groove common to the plural substrates, and cutting the base member into the substrates such that each of substrates has the liquid supply groove, and the liquid supply groove of each of the substrates is a portion of the common groove.

2 Claims, 4 Drawing Sheets

METHOD FOR MANUFACTURING AN INK JET HEAD

FIELD OF THE INVENTION AND RELATED ART

The present invention relates to a liquid jet recording head having a substrate provided with an ejection outlet for ejection liquid and an electrothermal transducer element for generating heat electric upon power supply to eject the liquid and a liquid jet recording apparatus having such a recording head.

Referring first to FIG. 4, there is shown in an exploded perspective view of a recording head of an orifice plate, partition plate and a substrate having an opening for constituting a supply port. FIG. 5 is a persepective view of a head having a substrate provided with supply groove having a supply port at an end portion. In FIGS. 4 and 5, the same reference numerals are assigned to the elements having the corresponding functions.

In the recording head of FIG. 4, an electrothermal transducer element 12 functioning as energy applying portion is provided on a substrate 11 of silicon or the like, and at the substrate 11, liquid supply port 13 is formed penetrating the substrate 11. At an end of a substrate 11, selection wiring electrode 15 and common wiring electrode 16 are formed through photolithography or the like. An ejection outlet 17*a* is disposed at a position faced to the electrothermal transducer element 12, and the orifice plate 17 is provided with the ejection outlet 17*a*. A partition plate 18 is provided with a partition 18*a* for isolating the ejection outlets 17*a*.

In the second example shown in FIG. 4, when the liquid supply port 13 is formed without form a hole in the substrate, a groove is formed in the substrate 11 to form a liquid supply port 13 at an end of the substrate.

With the structure of FIG. 4, wherein the hole is machined by ultrasonic wave machining or laser machining or the like or another method, there is a liability that the substrate is cracked when the machining is carried out. To avoid this, the machining speed can be reduced, but doing so is not satisfactory. Additionally, this method necessarily involves the reduction of productivity. The reduction in the yield and the productivity result in the cost increase.

In the case of the head having the groove as shown in FIG. 5, the problem of the crack is quite eased, but the problems of non-uniformity of the image density are found, when experiments are repeated with the recording head using the groove to supply the liquid. The problem particularly appears in the case of different duty pattern, line pattern, strip pattern extending in the scanning direction for checking twist. This was particularly remarkable when plural line print is effected by driving all of the ejection outlets. Then, the checking has been effected to the ejection amount of the ink for a number of ejection outlets, and it has been found that there are slight difference in the ejection amount amount between the ejection outlet near the liquid supply port and the ejection outlet remote therefrom. This would be a significant problem from the standpoint of the print quality.

After the recording head of FIG. 5 was left in the air, the re-driving thereof is tried. There were non-ejection nozzles, for which it was confirmed that the ink exists on the electrothermal transducer and that the cause of the non-ejection was not the absence of the ink on the electrothermal transducer. The investigations were further made as to a number of non-ejection nozzles to find common problem, and it was found that the non-ejection nozzles are those disposed remote from the liquid supply port. Particularly, the remotest nozzles showed the high probability of ejection failure. The reason is considered as being the viscosity increase. So, there is a problem to be solved, which is particularly remarkable at the remote ejection outlet.

SUMMARY OF THE INVENTION

Thus, one aspect of this invention involves a method for making liquid jet recording heads, each head having a substrate with ejection energy generating elements corresponding to liquid passages and a liquid supply groove for supplying liquid to the liquid passages. This is done by preparing a base member on which the ejection energy generating elements are disposed corresponding to the substrates, forming in the base member by dicing a groove common to the plural substrates, and cutting the base member into the substrates such that each of substrates has the liquid supply groove. The liquid supply groove of each of the substrates is a portion of the common groove.

Accordingly, it is a principal object of the present invention to provide a liquid jet recording head and a liquid jet apparatus, wherein the structure of the liquid supply passage is improved to prevent the substrate crack and the variation in the ink ejection amount resulting in the non-uniform printing.

It is another object of the present invention to provide a liquid jet recording head and liquid jet apparatus wherein smooth ejection can be effected even after the recording head is left in the air.

It is a further object of the present invention to provide a liquid jet recording head and liquid jet apparatus wherein the distribution of the temperature of the substrate is improved, and the propagation of the pressure wave to the ink supply port is suppressed, thus stabilizing the ink ejections.

According to an aspect of the present invention, there is provided a liquid jet recording head comprising a substrate on which a plurality of of arrays of ejection energy generating elements for ejecting liquid; liquid passages corresponding to said ejection energy generating elements; ejection outlets for ejecting the liquid, in a direction away from the substrate, said ejection outlets being in fluid communication with said liquid passages; a cross liquid supply passage, in the form of a groove, for supplying the liquid from opposite end portions of the substrate, said cross passage being extended across said substrate.

According to another aspect of the present invention, there is provided a liquid jet apparatus comprising a liquid jet recording head including a substrate on which a plurality of of arrays of ejection energy generating elements for ejecting liquid; liquid passages corresponding to said ejection energy generating elements; ejection outlets for ejection the liquid, in a direction away from the substrate, said ejection outlets being in fluid communication with said liquid passages; a cross liquid supply passage, in the form of a groove, for supplying the liquid from opposite end portions of the substrate, said cross passage being extended across said substrate; and means for feeding a recording material on which recording is effected.

According to a further aspect of the present invention, there is provided a liquid jet apparatus comprising a liquid jet recording head including a substrate on which a plurality of of arrays of ejection energy generating elements for ejecting liquid; liquid passages corresponding to said ejection energy generating elements; ejection outlets for ejecting the liquid, in a direction away from the substrate, said ejection outlets being in fluid communication with said liquid passages; a cross liquid supply passage, in the form of a groove, for supplying the liquid from opposite end portions of the substrate, said cross passage being extended across said substrate; and means for supplying a signal for driving said recording head.

According to the present invention, the liquid supply port is formed by formation of a groove in the substrate, and therefore, the problem of the crack is solved, and the in addition, the groove extends across the substrate, so that the liquid can be supplied from the opposite end portions of the substrate by which the variation of the ejection amount can be solved, and the liquid ejection at the resuming of the drive after being left in the air. In addition, the liquid refilling performance is improved, and the ejection failure due to the non-uniformity of the temperature of the substrate.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Referring to the accompanying drawings, the preferred embodiment of the present invention will be described in detail.

In the following description, ink is taken as a liquid but another liquid is usable.

Figure 1:
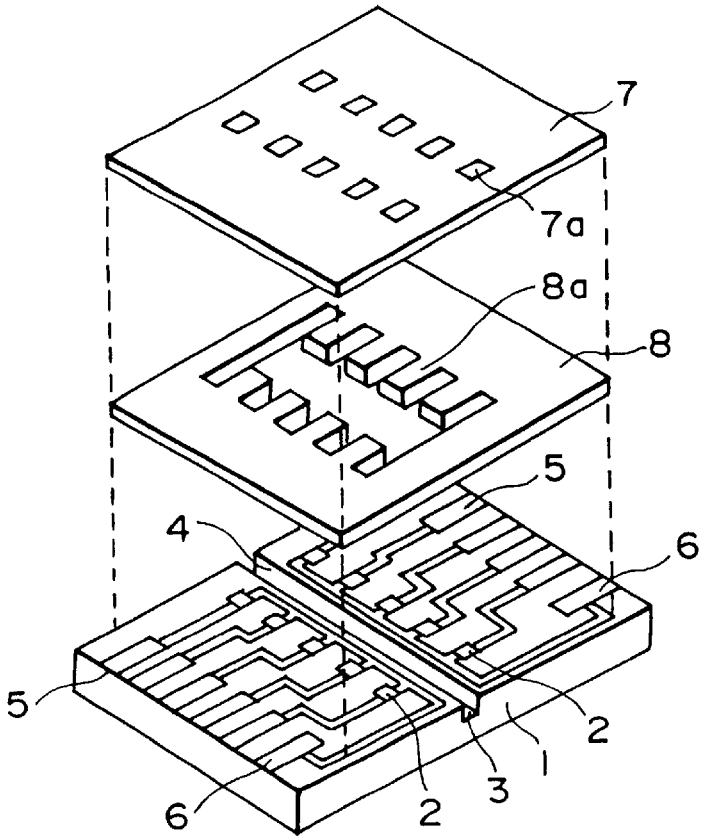
FIG. 1 is a perspective view of a substrate having electrodes adjacent the opposite end portions without the liquid supply port, partition wall and an orifice plate in a liquid jet recording head according to an embodiment of the present invention.

FIG. 1 is a perspective view of a liquid jet recording head according to an embodiment of the present invention, wherein the substrate has electrodes adjacent opposite ends not having the liquid supply port. In this Figure, a partition plate and the orifice plate are also shown.

In FIG. 1, the substrate 1 of silicon or the like, has an ejection energy generating element in the form of electrothermal transducer 2 manufactured through film forming process. The selection electrode 5 and common electrode 6 electrically connected to the electrothermal transducer element 2 are formed on the substrate 1 through the film forming process. The liquid supply passage 4 (groove) for supplying the ink, is formed in the substrate 1 by half-cutting with the use of a dicer, for example, between arrays of ejection energy generating elements across the substrate 1. In this embodiment, the width thereof is 200 microns approx. and the depth is 300 microns approx. The depth of the groove can be controlled by changing the width of the dicer, and the depth can be controlled very accurately by adjusting the dicer. Thus, the liquid supply port 3 can be formed without machining a hole in the substrate, the problem of the crack does not arise. Additionally, the grooves for a plurality of substrate 1 can be formed by forming a single groove. More particularly, the groove is not formed after the wafer is cut into the respective substrates, but the groove is formed on the wafer before, it is cut. When the respective substrates are subjected to the groove formation, the alignment before the groove formation is required for each substrate. If the accuracy of the alignment is not high enough, the variation will increase. According to this embodiment, one groove covers a plurality of substrates, so that the number of alignment operations can be reduced, and therefore, the machining period is reduced. Additionally, chipping which tends to occur at the start of the cutting does not occur for every substrate, thus avoiding the cost increase due to the decrease of the yield.

Figure 6:
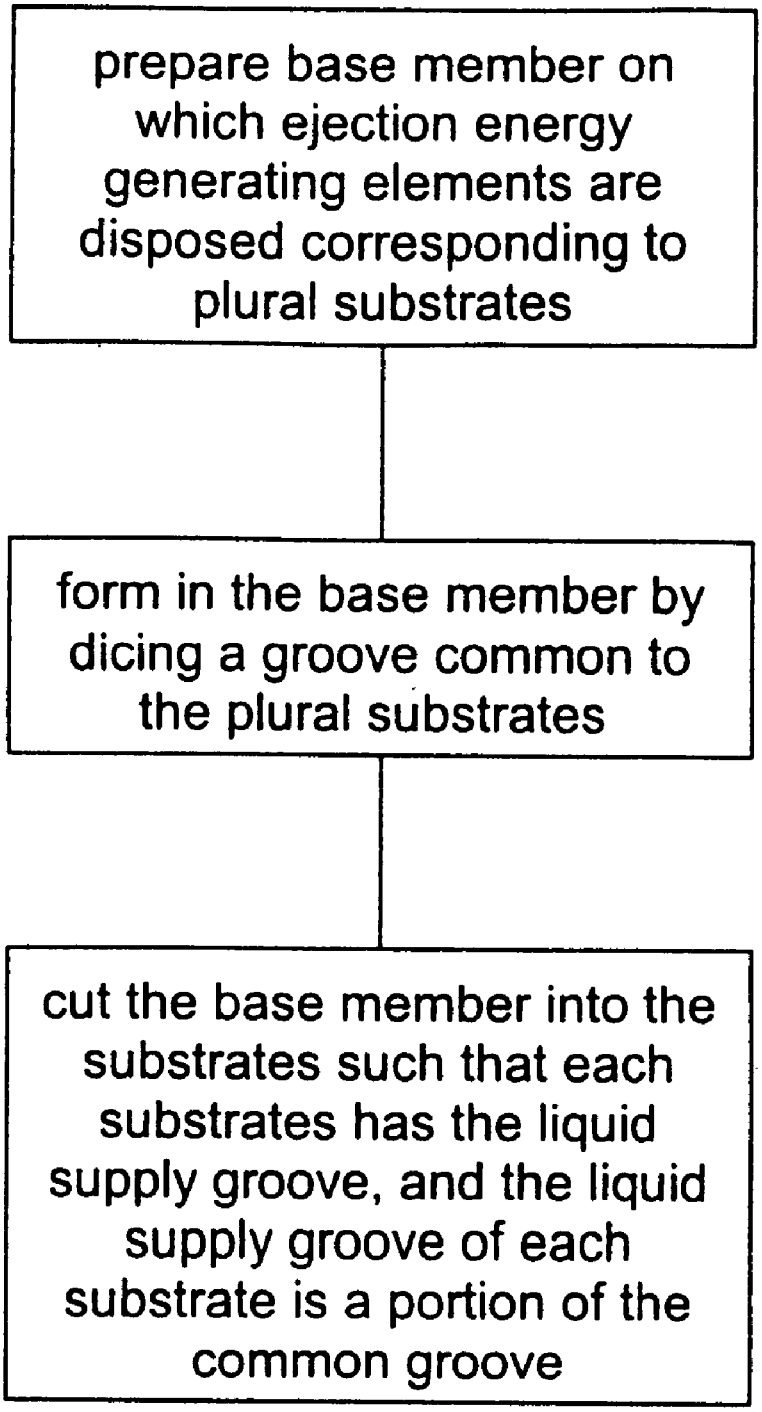
FIG. 6 is a flowchart depicting a method for manufacturing a liquid jet recording heads in accordance with the present invention.

As shown in FIG. 6, the method of making liquid jet recording heads in accordance with this invention is accomplished by preparing a base member on which ejection energy generating elements are disposed corresponding to plural substrates, forming in the base member by dicing a groove common to the substrates, and cutting the base member into substrates such that each of the substrates has the liquid supply groove, and the liquid supply groove of each of the substrates is a portion of the common groove.

Ejection outlets 7*a* are disposed corresponding to the electrothermal transducers. The orifice plate 7 is provided with a plurality of ejection outlets 7*a*, and comprise a resin material, gold, nickel or the like spattered or evaporated. In this embodiment, the ink is supplied from the liquid supply port to the electrothermal transducer element 2 through the liquid supply passage 4. The liquid supply passage 4 is defined by bare silicon, but the silicon is a proper material contactable with the ink without problem. As to the problem of the variation of the ejection amount among ejection outlets 7, the groove extend across the substrate, so that the ink can be supplied from the opposite ends, so that a sufficient amount of the ink can be supplied to the respective ejection outlets 7 independently of the distance from the liquid supply port 3. Thus, the constant amount in ink ejection can be assured. By this, the problem of the variation of the ink ejection amounts among the ejection outlets 7 could be solved. The problem of ejection failure after being left in the air is also solved by the use of the above-described structure.

As to the form of supplying the ink from the opposite sides of the substrate, two small substrates may be disposed with a gap therebetween corresponding to the groove of this embodiment, or the a substrate before formation of the groove may be disposed on the substrate, and then the substrate is cut, and the portion reduced by the cutting is used as the groove. With this form, however, the temperatures of the substrates will become different from each other with the operation, and therefore, there is a liability of variation of the ink ejection amount. From this standpoint, the structure or form of this embodiment is preferable. According to this embodiment, the substrates are connected with the boundary of the groove so that the temperature is uniformed by the heat transfer, thus assuring the stable ink ejection. In view of this, it is desirable that the groove formation leaves one fourth thickness of the total thickness of the substrate, in other words, the groove has a depth not more than ¾ of the total thickness. From the standpoint of the mechanical strength of the substrate, not less than 150 mm thick remains.

As to another form of supplying the ink from the opposite sides of the substrate, it would be considered that ink passage and supply port are formed to permit the ink supply from the opposite sides without formation of the groove. With this structure, however, the presence wave produced in the ink adjacent the ejection energy generating element is directly propagated to the supply port with the result of impedance of the ink refilling.

According to this embodiment, however, the height of the ejection energy generating element and the high of the liquid supply port are different by the depth of the groove, which is effective to suppress the direct propagation of the ink to the inlet port. From this standpoint, the formation of the groove in this embodiment is preferable.

Figure 2:
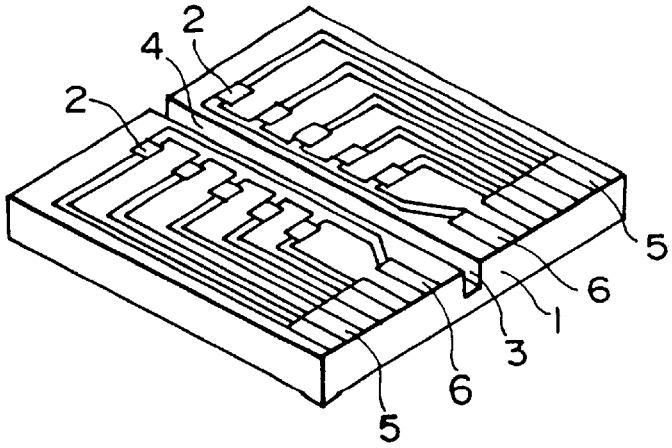
FIG. 2 is a perspective view of a substrate having electrodes adjacent an end with the liquid supply port.

Referring to FIG. 2, a second embodiment of the present invention will be described, wherein the electrode is disposed adjacent such one of the end as has the liquid port. The same reference numerals as in FIG. 1 are assigned to the elements having the corresponding functions, and the detailed description thereof are omitted for simplicity.

Similarly to FIG. 1 embodiment, the liquid supply passage 4 is formed by formation of the cross groove in the substrate 1. However, this embodiment is different from the FIG. 1 embodiment in that the selection electrode 5 and the common electrode 6 are disposed adjacent such one of the ends as has the liquid supply port 3, similarly to the structures described in the introductory part of this specification. The structure of this embodiment is also effective to solve the above-described problems. However, when one groove is formed on the wafer, the groove covers a smaller number of substrate than in the FIG. 1 embodiment, and therefore, the advantage in the chipping and variation is a little less. The ink supply performance is the same as in FIG. 1 embodiment.

Figure 3:
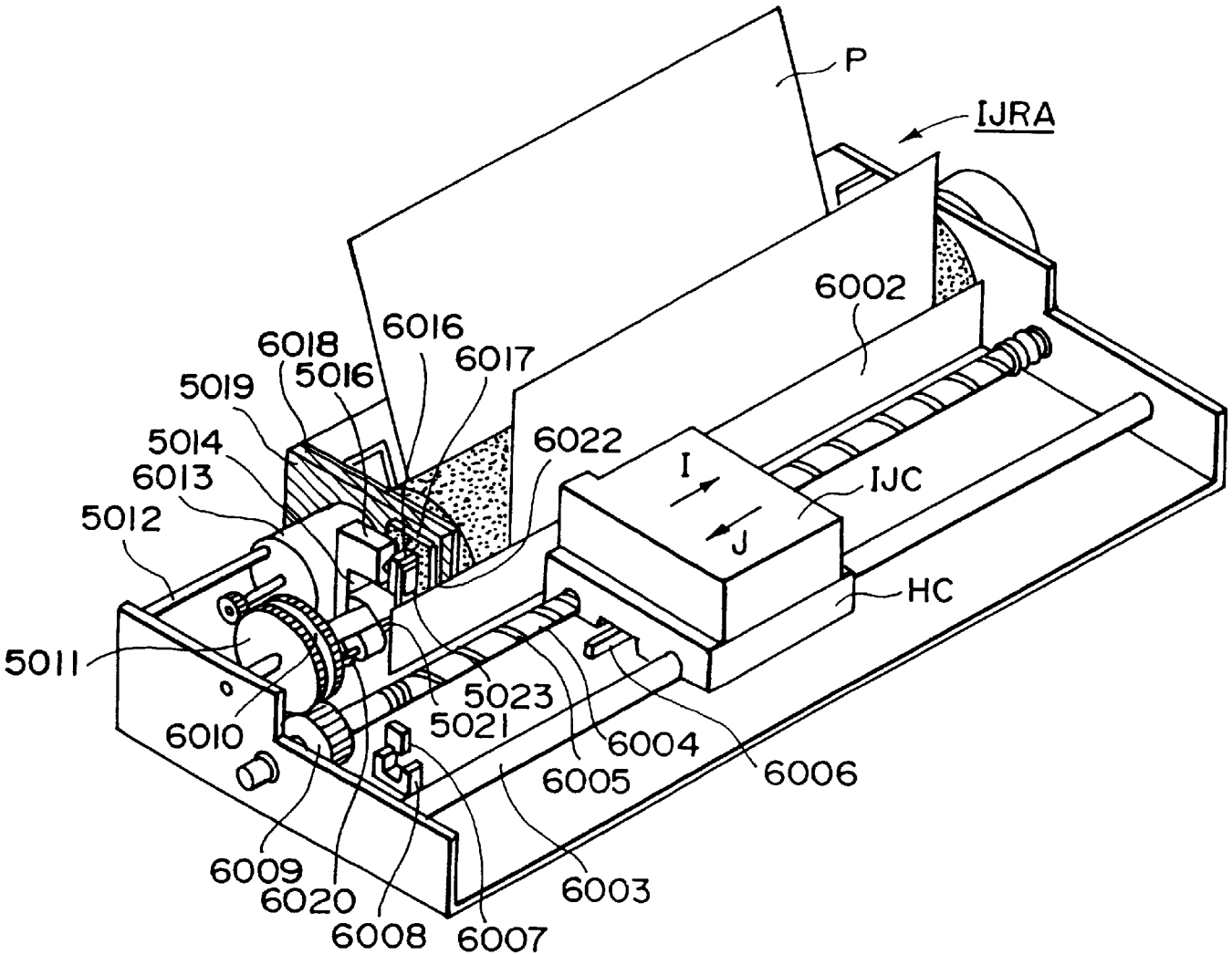
FIG. 3 is a perspective view of an ink jet recording apparatus using the head according to the present invention.
Figure 4:
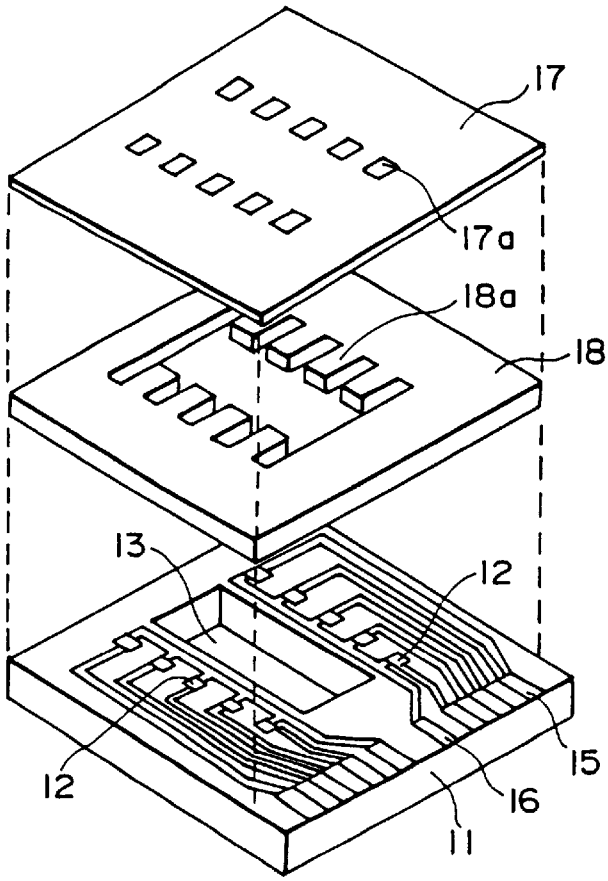
FIG. 4 PRIOR ART
FIG. 4 is a perspective view of a substrate, partition wall and orifice plate in a structure not using the present invention.
Figure 5:
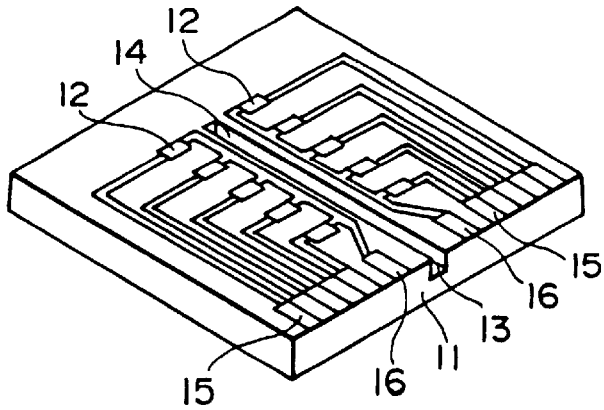
FIG. 5 PRIOR ART
FIG. 5 is a perspective view of a substrate, partition wall and orifice plate in another example of the prior art structure.

FIG. 3 shows an ink jet recording apparatus IJRA to which the present invention is applicable. There is provided a carriage HC engageable with a helical groove 5004 of a lead screw 5005 driven by a reversible motor 5013 through drive transmission gears 5011 and 5009. The head carriage HC has a pin (not shown) to be reciprocable in a directions a and b indicated by arrows. A sheet confining plate functions to confine the sheet on a platen 5000 over a carriage movement direction. Elements 5007 and 5008 constitutes a photocoupler and functions as a home position detector to detect presence of a lever 5006 of the carriage to switch the motor rotating direction. Designated by a reference numeral 5016 is a member for supporting a capping member 5022 for capping an ejection side surface of the recording head, and sucking means 5015 sucks the recording head through an opening 5023 of the cap to recover the recording head. A cleaning blade 5017 is moved to and fro by a member 5019, and they are supported on a frame plate 5018. The blade may take another known form. A lever 5012 functions to start the sucking operation, and moved with movement of a cam 5020 engaged with the carriage, and the the driving force from the driving motor is controlled by a known transmission means such as clutch.

The capping, cleaning and sucking operations are carried out when the carriage is adjacent the home position, by the operation of the lead screw. However, this invention is not limited to this timing, but another timing is usable. This structure is suitably incorporated in the present invention.

The apparatus comprises a drive signal supplying means for supplying the signals for energizing the ink ejection energy generating elements.

As described in the foregoing, according to the present invention, the liquid can be supplied from the opposite ends of the substrate, so that the variation in the ejection amount among nozzles which may cause the non-uniform printing, can be avoided, and in addition, the smooth starting operation after the head is left in the air, can be assured.

While the invention has been described with reference to the structures disclosed herein, it is not confined to the details set forth and this application is intended to cover such modifications or changes as may come within the purpose of the improvements or the scope of the following claims.

What is claimed is:

1. A method for manufacturing a plurality of liquid jet recording heads, each said head having a substrate having a plurality of ejection energy generating elements corresponding to a plurality of liquid passages and a liquid supply groove for supplying liquid to the liquid passages, comprising the steps of:

preparing a base member on which the plurality of the ejection energy generating elements are disposed corresponding to said plurality of substrates;

forming in said base member by dicing a groove common to said plurality of substrates; and cutting said base member into said substrates such that each of said substrates has the liquid supply groove, and the liquid supply groove of each of the substrates is a portion of the common groove.

2. A method according to claim 1, wherein said ejection energy generating elements are heat generating members.

* * * * *

UNITED STATES PATENT AND TRADEMARK OFFICE

CERTIFICATE OF CORRECTION

PATENT NO. : 6,190,005 B1
DATED : February 20, 2001
INVENTOR(S) : Shuichi Murakami It is certified that error appears in the above-identified patent and that said Letters Patent is hereby corrected as shown below:

Title page,
Item [56], *Assistant Examiner*, "M. Brooke" should read -- Michael S. Brooke --.

Drawings,
Sheet 4, Figure 6, "substrates" (fourth occurrence) should read -- substrate --.

Column 1,
Line 9, "electric upon" should read -- upon electric --;
Line 32, "form" should read -- forming --;
Line 41, "reduction" should read -- reductions --;
Line 55, "difference" should read -- differences --.

Column 2,
Line 16, "of" should read -- of the --;
Line 36, "of of" should read -- of --;
Line 49, "of of" should read -- of --;
Line 51, "ejection (second occurrence)" should read -- ejecting --;
Line 62, "of of" should read -- of --.

Column 3,
Line 7, "the" (third occurrence) should be deleted;
Line 13, "failure" should read -- failure is --;
Line 39, "a liquid" should read -- liquid --.

Column 4,
Line 7, "before," should read -- before --;
Line 30, "comprise" should read -- comprises --;
Line 38, "extend" should read -- extends --;
Line 51, "the a" should read -- the --.

UNITED STATES PATENT AND TRADEMARK OFFICE

CERTIFICATE OF CORRECTION

PATENT NO. : 6,190,005 B1
DATED : February 20, 2001
INVENTOR(S) : Shuichi Murakami It is certified that error appears in the above-identified patent and that said Letters Patent is hereby corrected as shown below:

Column 5,
Line 17, "liquid" should read -- liquid supply --;
Line 20, "description" should read -- descriptions --;
Line 40, "in a" should read -- in --.

Column 6,
Line 7, "the the" should read -- the --.

Signed and Sealed this

Sixteenth Day of April, 2002

*Attest:*

*Attesting Officer*

JAMES E. ROGAN
*Director of the United States Patent and Trademark Office*